US005197556A

United States Patent [19]

Jordan

[11] Patent Number: 5,197,556

[45] Date of Patent: Mar. 30, 1993

[54] ROOF DRILL BRAZING SHIM

[75] Inventor: William M. Jordan, Abingdon, Va.

[73] Assignee: GTE Valenite Corporation, Troy, Mich.

[21] Appl. No.: 716,199

[22] Filed: Jun. 17, 1991

[51] Int. Cl.[5] ..... E21B 10/58

[52] U.S. Cl. ..... 175/432; 76/108.2; 228/189

[58] Field of Search ..... 76/108.1, 108.2, 108.4, 76/108.6, DIG. 10, DIG. 11; 408/144, 145, 227, 230; 228/122, 189, 263.12; 175/427, 430–432

[56] References Cited

U.S. PATENT DOCUMENTS 4,817,742 4/1989 Whysong ..... 76/108.2 X
4,821,819 4/1989 Whysong ..... 228/263.12 X

*Primary Examiner*—Ramon S. Britts
*Assistant Examiner*—Roger J. Schoeppel
*Attorney, Agent, or Firm*—Bill C. Panagos

[57] ABSTRACT

A U-shaped sheet metal brazing shim for disposition within a groove in a drill bit body to encircle the edge area of a plate-type cutting insert. Brazing alloy is provided to form bonds between the shim and opposed surfaces on the cutting insert and drill bit body. Closely spaced holes extend across essentially the entire surface of the metal sheet to provide thermal stress relief within the brazed joint. Border areas of the sheet are left unperforated so that edges of the sheet are relatively smooth and free of sharp projections that could cut into a person's hand while the shim is being handled or repositioned.

2 Claims, 2 Drawing Sheets

ROOF DRILL BRAZING SHIM

BACKGROUND OF THE INVENTION

1. Field of the Invention

This invention relates to coal mine roof drilling tools, and particularly to a brazing shim locatable between a drill bit body and a plate-type cutter insert to facilitate a brazing operation between the drill bit body and cutter insert.

2. Description of Prior Developments

U.S. Pat. No. 4,817,742 to H. Whysong shows a drilling tool wherein a U cross-sectioned butterfly shim is interposed between a plate-type cutter insert and a drill bit body to facilitate a brazing operation between the bit body and cutter insert. The shim is formed out of a flat metal sheet, as shown in FIG. 13 of the patent. Prior to the sheet being bent into its U cross-sectional configuration a series of perforations are punched through the sheet surface. The perforations extend through a central region of the sheet from one edge of the sheet to an opposite edge of the sheet, leaving side regions of the sheet unperforated. Perforations at edge areas of the sheet give the sheet edge a sharp jagged profile that can be a problem for a person handling and manipulating the shim during the process of positioning the shim between the bit body and the cutter insert. The sharp jagged edges can puncture or cut into the person's fingers.

The personal injury problem is aggravated by the fact that in some real time situations the entire surface area of the shim is perforated. In such cases the entire edge surface is sharp and jagged.

SUMMARY OF THE PRESENT INVENTION

The present invention relates to a sheet metal brazing shim having a series of closely spaced perforations covering its entire surface, except that peripheral edge areas of the sheet are left unperforated. By leaving the sheet edge areas unperforated the edge surfaces will be smooth and uninterrrupted so that the sheet metal shim can be manipulated relative to the cutter insert and drill bit body without cutting or puncturing the person's fingers.

In a typical shim construction the shim will be a copper sheet having a thickness of about 0.02 inch; the perforations will be circular holes having diameters of about one eighth inch. The holes will have centerline spacings of about five thirty secondths inch, and the perforation-free edge area of the sheet will be about one sixteenth inch measured from the edge of the sheet along the sheet surface. The entire edge surface of the sheet will be smooth and uninterrupted so that the person can handle the shim without cutting or puncturing his/her fingers.

THE DRAWINGS

DESCRIPTION OF A PREFERRED EMBODIMENT OF THE INVENTION

Figure 1:
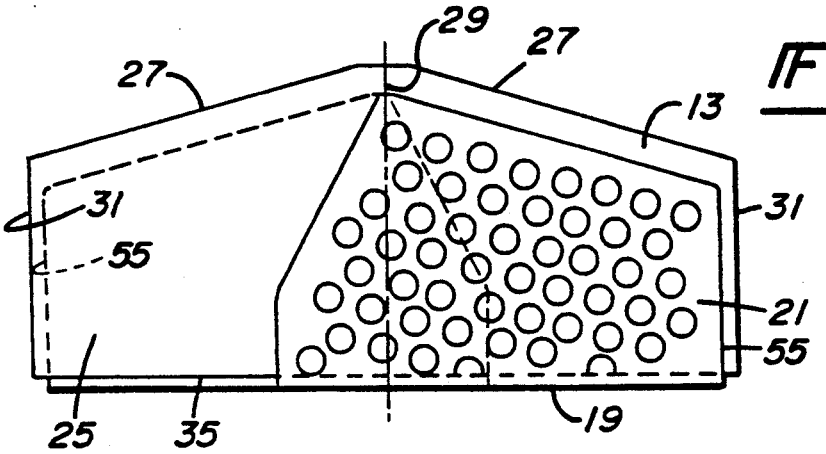
FIG. 1 is an elevational view of a plate-type cutter insert having a sheet metal shim of the present invention installed thereon.
Figure 5:
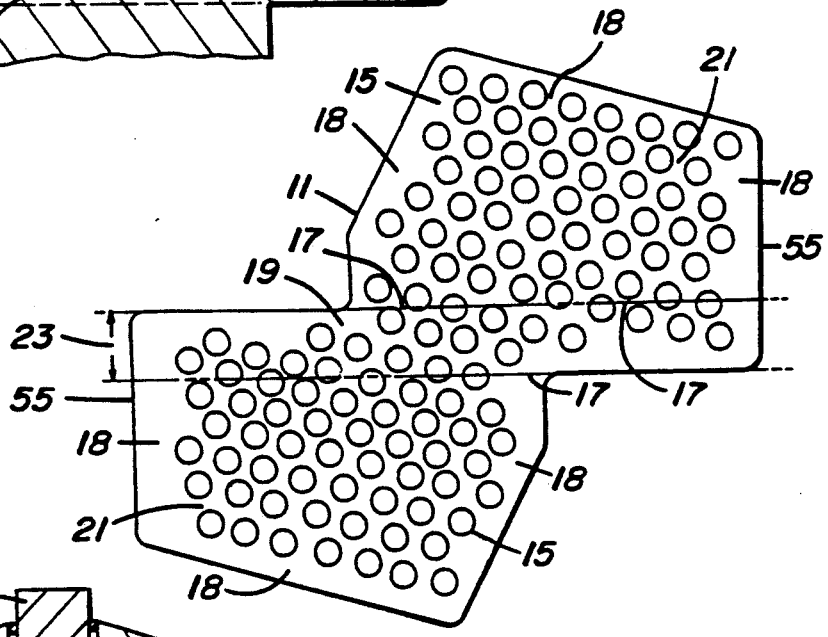
FIG. 5 is a plan view of the FIG. 1 sheet metal shim, but taken in the flat state prior to the metal sheet being bent into its final configuration.

FIG. 5 of the drawings shows a sheet metal brazing shim 11 of the present invention in a initial flat state prior to its being formed into a U configuration for assembly onto the plate-type cutter insert 13 shown in FIG. 1. Sheet 11 has a series of circular holes 15 extending therethrough substantially along its entire surface. These holes, or perforations, cover the entire sheet surface except for a peripheral area of the sheet along its edges; The peripheral area left unperforated is designated generally by numeral 18. Each unperforated peripheral area is preferably about one sixteenth inch, measured from the sheet edge. The edge is left smooth and uninterrupted so that the shim can be handled and manipulated without danger that the edge of the sheet could cut or puncture the person's fingers.

Figure 2:
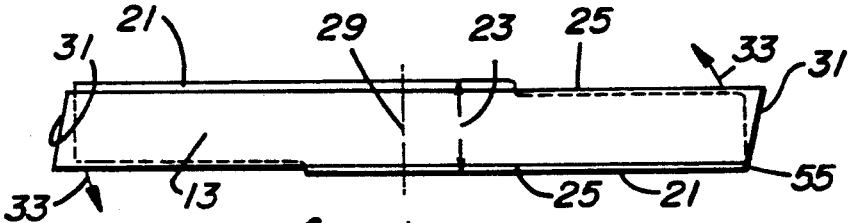
FIG. 2 is a top edge view of the FIG. 1 assembly.

The metal sheet 11 is formed into a U cross-sectional configuration by bending the sheet along two parallel bend lines 17. Each bend has a sharp ninety degree angle, whereby the sheet is subdivided into a flat web wall 19 and two flat flange walls 21. Bend lines 17 are spaced apart by a distance that is the same as the width dimension 23 of cutter insert 13 (FIG. 2). Therefore, the U cross-sectioned shim can be installed on the cutter insert with flange walls 21 tightly gripping side faces 25 of the cutter insert.

Cutter insert 13 is a flat plate formed out of tungsten carbide to a sharpened edge configuration for cutting through coal rock or analogous material. The drill assembly has use in drilling holes in coal mine roofs. The plate-type cutter insert has sharpened end edges 27 acutely angled to the plate rotational axis 29, and sharpened side edges 31 extending parallel to rotational axis 29. The cutter insert is designed for rotation in the direction indicated by arrows 33 in FIG. 1.

The U cross-sectioned shim 11 may be installed on cutter insert 13 so that its flat web wall 19 is in facial contact with a flat transverse edge 35 on insert 13; flange walls 21 of the shim are then in tight gripping engagement with flat side faces 25 of the cutter insert.

Figure 3:
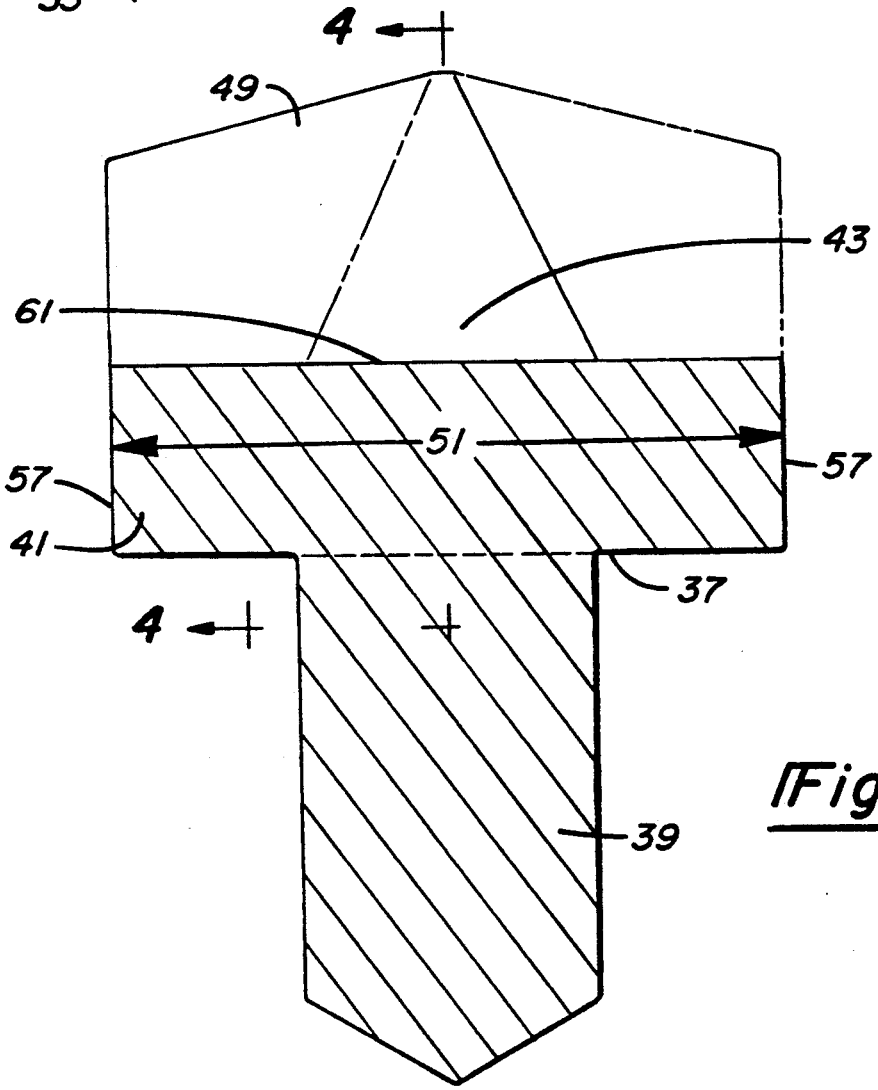
FIG. 3 is a sectional view taken through a drill bit body adapted to receive the shim-cutter insert assembly of FIG. 1.

As an alternate installation procedure, the U cross-sectioned shim 11 can be initially installed into a groove formed in a drill bit body 37 (FIG. 3). The drill bit body is formed out of steel into a bifurcated construction suitable for receiving the cutter insert-shim assembly of FIG. 1. The drill bit body has a shank portion 39 adapted to be chucked into a non-illustrated drilling machine, and a head portion 41 adapted to be brazed to the insert-shim assembly.

Figure 4:
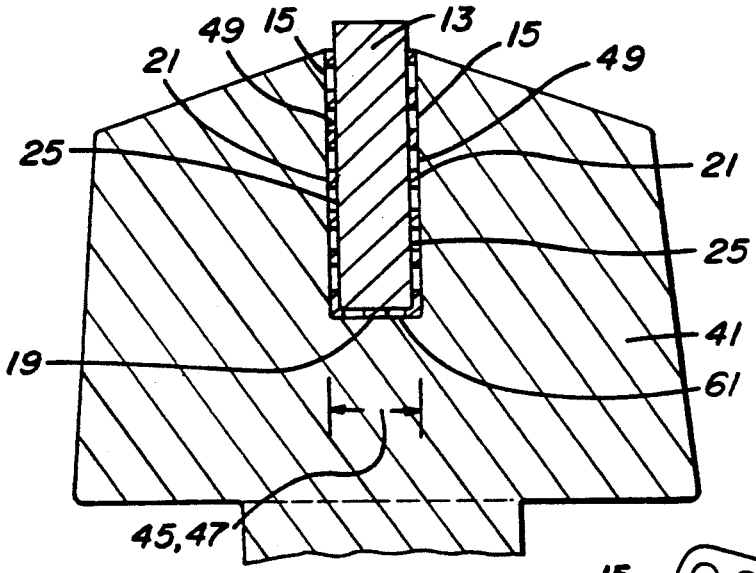
FIG. 4 is a transverse sectional view taken on line 4—4 in FIG. 3, but with the shim-cutter insert assembly of FIG. 1 installed in the drill bit body.

Head portion 41 of the drill body has a groove 43 extending transversely thereacross for accommodating the cutter insert and associated brazing shim. The transverse width dimension 45 of groove 43 is essentially the same as the transverse width dimension 47 of the cutter insert-shim assembly (FIG. 4), such that when the insert-shim assembly is inserted into groove 43 the flange walls 21 of the shim will be in facial contact with side surfaces 49 of the groove.

The length of web wall 19, as seen in FIG. 1 is the same as the length dimension 51 of groove 43 (or the diametrical dimension of head portion 41). When the cutter insert-shim assembly is oriented so that side edges 55 of the shim are in alignment with opposite side surfaces 57 of the drill bit body the shim will be correctly oriented relative to the drill bit body. Proper orientation of the cutter insert is also required; the side edges of the cutter insert at its trailing face should be aligned with the side edges 55 of the shim for correct alignment of the cutter insert axis with the drill bit body axis.

Some manual repositionment of the cutter insert and brazing shim will usually be necessary in order to achieve the necessary coincidence between the cutter insert axis and the drill bit body axis. With prior art shims having perforations along the entire shim surface the shim edges were jagged and discontinuous, such that manual insertion and shifting of the shim could result in cuts or punctures in the person's fingers. With the shim perforation pattern shown in FIG. 5 the shim edges are smooth and non-jagged. The shim can be installed onto cutter insert 13, and shifted back and forth within groove 43 in body 37 without danger of cutting or puncturing the person's fingers.

The brazing operation involves heating the entire assembly (FIG. 4) such that the brazing alloy melts and resolidifies to form a large area bond between shim walls 19 and 21 and the facially-contacted surfaces on cutter insert 13 and drill bit body 37. Perforations 15 reduce thermal stresses that could otherwise be generated due to the unequal thermal expansion of the cutter insert material and the drill bit body material.

Figure 7:
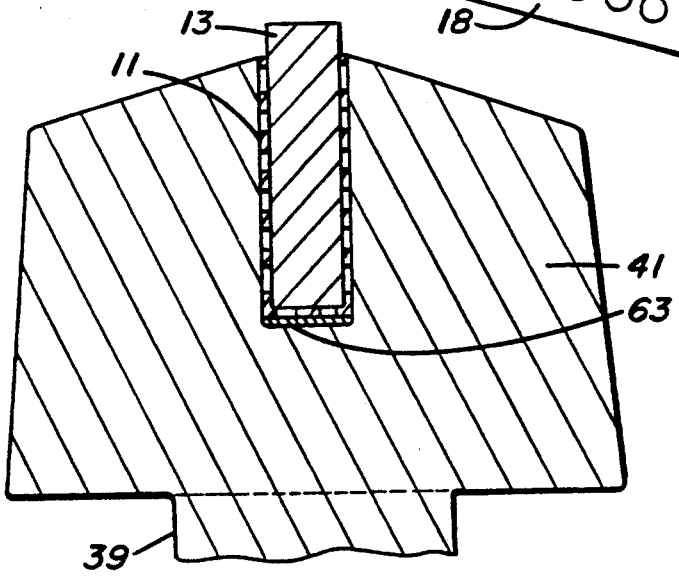
FIG. 7 is a sectional view taken in the same direction as FIG. 4, but showing an alternative arrangement according to the invention.
Figure 6:
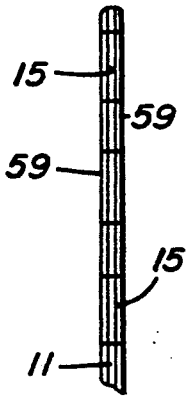
FIG. 6 is a fragmentary enlarged sectional view through a sheet metal shim wall structure that could be used i practice of the invention.

The brazing alloy can be a brass alloy containing copper and zinc. The brazing alloy can be provided as two thin films or laminations on opposite faces of the shim sheet. FIG. 6 references these brazing alloy films with reference numeral 59. Alternately, the brazing alloy can be provided as a strip or bar placed between web wall 19 of the shim and bottom wall (surface) 61 of groove 43; FIG. 7 shows a strip 63 of brazing alloy placed in the desired location. The brazing strip will extend the entire length of web wall 19. When the strip of brazing alloy is fused it will flow by capillary action into and along the various interface cracks formed between shim 11 and the associated cutter insert 13 and drill bit body 37. A standard flux (e.g. borax) coating can be provided on the various surfaces to promote a capillary flow.

The primary feature of this invention is the hole pattern shown in FIG. 5, whereby substantially the entire surface of the sheet metal shim is covered with holes, except for the relatively narrow peripheral border area 18. The unperforated area 18 extends a slight distance from the sheet edges along the sheet surface. The width of the unperforated area may be about one sixteenth inch, which is sufficient to maintain structural integrity of the sheet edge when subjected to normal handling, e.g. during shipment or use in the field.

The drawings necessarily depict a specific form of the invention. However, it will be appreciated that some changes in component configurations and materials can be made while still practicing the invention.

What is claimed is:

1. A butterfly-type shim locateable in a groove in a drill bit body in surrounding relation to the edge area of a plate-type cutter insert seated within the groove; said shim being formed out of a metallic sheet bent into a U cross-sectional configuration; said U cross-sectional configuration comprising an elongated flat web wall having a width dimension that is the same as the width of the plate-type cutter insert, and a length dimension that is the same as the length dimension of the groove in the drill bit body; said U cross-sectional configuration further comprising two flat flange walls bent at ninety degrees to the web wall to lie against opposite side faces of the plate-type cutter insert; each flange wall having a side edge (55) extending normal to the longitudinal axis of the web wall for alignment with a side surface of the bit body and a side edge of the cutter insert; said shim being dimensioned so that its flange walls tightly grip opposite side faces of the plate-type cutter insert when said web wall of the shim is engaged with an edge surface of the cutter insert; said metallic sheet having a series of closely spaced perforations extending therethrough; said perforations covering the entire surface of the sheet except for a peripheral area of the sheet along its edges; the sheet edges being smooth and uninterrupted, so that the sheet metal shim can be manipulated and adjusted relative to the cutter insert and drill bit body without cutting the person's fingers.

2. The butterfly-type shim of claim 1, wherein said peripheral area of the sheet measures approximately one sixteenth inch, measured from the edge of the sheet along the sheet surface.

* * * * *